US010145345B2

(12) United States Patent
Dutt et al.

(10) Patent No.: US 10,145,345 B2
(45) Date of Patent: Dec. 4, 2018

(54) FLUID CONVEYANCE SYSTEM FOR A FLUID

(71) Applicant: Robert Bosch GmbH, Stuttgart (DE)

(72) Inventors: Andreas Dutt, Stuttgart (DE); Achim Koehler, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 280 days.

(21) Appl. No.: 15/023,329

(22) PCT Filed: Sep. 11, 2014

(86) PCT No.: PCT/EP2014/069385
§ 371 (c)(1),
(2) Date: Mar. 18, 2016

(87) PCT Pub. No.: WO2015/039948
PCT Pub. Date: Mar. 26, 2015

(65) Prior Publication Data

US 2016/0230726 A1 Aug. 11, 2016

(30) Foreign Application Priority Data

Sep. 19, 2013 (DE) ..... 10 2013 218 873

(51) Int. Cl.
*F04B 11/00* (2006.01)
*F02M 55/04* (2006.01)
(Continued)

(52) U.S. Cl.
CPC ..... *F02M 55/04* (2013.01); *F02M 63/0001* (2013.01); *F02M 69/54* (2013.01);
(Continued)

(58) Field of Classification Search
CPC .. F02M 55/04; F02M 2200/315; F02M 69/54; F16L 55/05; Y10T 137/7836; F04B 11/0008; F04B 11/0033; F04B 53/004
See application file for complete search history.

(56) References Cited

U.S. PATENT DOCUMENTS

| | | | | |
|---|---|---|---|---|
| 7,789,071 | B2 | 9/2010 | Akita et al. | |
| 2006/0005815 | A1 | 1/2006 | Magel et al. | |
| 2010/0212639 | A1 * | 8/2010 | Nakane | F02M 37/0041 123/511 |

FOREIGN PATENT DOCUMENTS

| | | | |
|---|---|---|---|
| CN | 102338012 | A | 2/2012 |
| DE | 19900564 | C2 | 9/2003 |

(Continued)

OTHER PUBLICATIONS

International Search Report for Application No. PCT/EP2014/069385 dated Nov. 17, 2014 (English Translation, 2 pages).

*Primary Examiner* — Kenneth J Hansen
(74) *Attorney, Agent, or Firm* — Michael Best & Friedrich LLP

(57) ABSTRACT

The invention relates to a fluid conveyance system for a fluid, comprising a low-pressure conveyance system having a low-pressure pump (2) and a high-pressure conveyance system having a high-pressure pump (8), which are connected by means of a connecting line, wherein the fluid conveyance system has a pressure damper (19). According to the invention, a fluid conveyance system is provided, by means of which a pulsation of the fluid caused by flow-rate waves or pressure waves in the fluid is damped. This is achieved in that the pressure damper (19) is arranged in the lower-pressure conveyance system and is a hydraulic pressure damper (19). Said hydraulic damper (19) has a piston (21) arranged in a cylinder (20), which piston can be moved against the force of a compression spring (23) and the vapor
(Continued)

pressure present in a compression-spring chamber (22) accommodating the compression spring.

6 Claims, 3 Drawing Sheets

(51) Int. Cl.
*F02M 63/00* (2006.01)
*F02M 69/54* (2006.01)

(52) U.S. Cl.
CPC ..... *F04B 11/0008* (2013.01); *F02M 2200/28* (2013.01); *F02M 2200/315* (2013.01)

(56) References Cited

FOREIGN PATENT DOCUMENTS

| | | |
|---|---|---|
| DE | 102007038426 | 2/2009 |
| DE | 102011087957 | 6/2013 |
| EP | 1184568 | 3/2002 |
| WO | 2014095271 | 6/2014 |

* cited by examiner

FLUID CONVEYANCE SYSTEM FOR A FLUID

BACKGROUND OF THE INVENTION

The invention concerns a fluid conveyance system for a fluid, comprising a low-pressure conveyance system with a low-pressure pump and a high-pressure conveyance system with a high-pressure pump which are connected via a connecting line, and wherein the fluid conveyance system has a pressure damper. The invention furthermore concerns a method for operating such a fluid conveyance system.

Such a fluid conveyance system is known from DE 10 2011 087 957 A1. This fluid conveyance system is configured as a fuel delivery system of a common rail injection system for an internal combustion engine. The fuel delivery system has a low-pressure conveyance system with a low-pressure pump and a high-pressure conveyance system with a high-pressure pump. The two systems are connected together via a connecting line. Furthermore, the high-pressure conveyance system has a pressure damper connected to a stub line. This stub line is connected to the high-pressure pump.

SUMMARY OF THE INVENTION

The invention is based on the object of providing a fluid conveyance system with which a pulsation of the fluid is damped.

This object is achieved in that the pressure damper is arranged in the low-pressure conveyance system and is a hydraulic pressure damper.

The corresponding method for operating such a fluid conveyance system provides that bulk waves and/or pressure waves of the fluid occurring in the low-pressure conveyance system are compensated by a pressure damper formed as a hydraulic pressure damper. This embodiment and this method are based on the knowledge that high pulsations of fluid occur in particular in the low-pressure conveyance system, and greatly strain the components arranged in the low-pressure conveyance system. Also, the pulsations can excite lines in the region of the low-pressure conveyance system to oscillation, and thus provoke noise nuisance. By arranging the pressure damper in the low-pressure conveyance system, the pulsations produced by a high-pressure pump—configured for example as a piston pump—which propagate as bulk waves or pressure waves in particular in the low-pressure conveyance system, are effectively damped. These pulsations are produced by the high-frequency, discontinuous pumping behavior of the piston pump, wherein the pulsations propagate into the low-pressure lines, in particular the connecting lines in the form of a supply line and/or return line, and into the components, such as for example filters, installed in the connecting lines between the low-pressure conveyance system and the high-pressure conveyance system. These bulk waves become pressure waves due to flow resistances in the corresponding lines or choke points in the lines. These bulk waves and pressure waves load said components and disrupt the filling of the pumping element of the high-pressure pump. The hydraulic damper, which may be arranged in the supply line or the return line or in both the supply line and the return line, balances the bulk waves emitted by the high-pressure pump so that no pressure waves result. Depending on the configuration of the fluid conveyance system, a plurality of hydraulic pressure dampers may be arranged in both the supply line and the return line.

In a refinement of the invention, the hydraulic pressure damper has a piston arranged in a cylinder and subjected to the force of compression spring. This embodiment is structurally simple to implement. The piston and the cylinder may be made of a metallic or non-metallic material, for example plastic, while the compression spring is preferably made of spring steel.

In a further embodiment of the invention, the compression spring is arranged in a compression spring chamber, wherein a damper chamber lies opposite the compression spring chamber on the piston side. In a further embodiment of the invention, this damper chamber is connected via a damper supply line to the connecting line, which may be the supply line or the return line. This connection to the connecting line may take place at any arbitrary point on the connecting line, wherein this connection also includes the opening of the connecting line into the high-pressure pump. In particular, the connection and hence the hydraulic pressure damper may be integrated directly in the high-pressure pump.

In a further embodiment of the invention, the compression spring chamber is connected by a compression spring chamber line directly or indirectly to the connecting line downstream of the branch point into the damper supply line. In a refinement of the invention, a check valve or a choke is inserted in the compression spring chamber line, closing towards the compression spring chamber. Where applicable, it is also possible to insert both a check valve and a choke in the compression spring chamber line.

As a result of the bulk waves and/or pressure waves, due to the fluid flowing into the damper chamber, the piston is displaced against the force of the compression spring in the direction of the compression spring chamber, whereby a damping of the bulk wave or pressure wave occurs in the damper chamber and hence also in the connecting line and the components installed in the connecting line. Following the bulk wave or pressure wave, the compression spring and the (fluid) pressure predominating in the compression spring chamber move the piston in the direction of the damper chamber, while the pressure in the enlarging compression spring chamber falls to the constant vapor pressure, which for example may correspond at least approximately to atmospheric pressure. Due to this expansion, by separation out of the fluid, vapor occurs which has a different compression behavior from the fluid and which effectively damps the bulk waves or pressure waves. When the system is set up, the compression spring is configured such that this (together with the pressure predominating in the compression spring chamber) presses the piston back more quickly in the direction of the damper chamber than the bulk wave of the fluid can reach the damper chamber and press the piston back in the direction of the compression spring chamber. This expansion in the compression spring chamber leads to vapor in the compression spring chamber which achieves the desired damping behavior on the next bulk wave. A leakage flowing past the piston in the compression spring chamber is small in comparison with the volume in the compression spring chamber and not therefore relevant for the vapor formation. A bulk wave speeding through the connecting line causes, due to line losses or an optional choke, a differential pressure $\Delta P = P1 - P2$. Due to this pressure P1 in the damper chamber, the piston in the hydraulic damper is pressed back against the compression spring and the atmospheric pressure, against the force direction of the compression spring, until the vapor produced by the preceding expansion in the compression spring chamber again transforms into fluid. Due to compression of the fluid, the pressure in the compression spring chamber rises so that the check valve opens and the fluid, essentially the leakage, is pressed into the compression spring chamber line. The same effect occurs on the presence of an outflow choke in the compression spring chamber line. This dynamic process ensures that the compression chamber is not gradually filled completely by leakage. An outflow choke may be used in particular if the return pressure is low and very close to the vapor pressure of the fluid, and if the pressure pulsations, i.e. the bulk waves and/or pressure waves, have a very high frequency.

In a refinement of the invention, the connecting line has a choke between the damper supply line and the compression spring chamber line. This choke is optional and ensures that the above-mentioned pressure difference ΔP is set.

In a refinement of the invention, the fluid conveyance system is a fuel delivery system and the fluid is fuel. Although the subject of the present invention may be used in an arbitrary fluid conveyance system, the preferred application is in a fuel delivery system. This fuel delivery system is for example a common rail injection system, in which fuel supplied by the low-pressure conveyance system to the high-pressure conveyance system is delivered by the high-pressure pump into a high-pressure accumulator. From this high-pressure accumulator, fuel injectors extract the stored fuel for controlled injection into assigned combustion chambers of an internal combustion engine to which the fuel delivery system is fitted.

Further advantageous embodiments of the invention are disclosed in the description of the drawing, which describes in more detail the exemplary embodiments of the invention shown in the figures.

DETAILED DESCRIPTION

Figure 1:
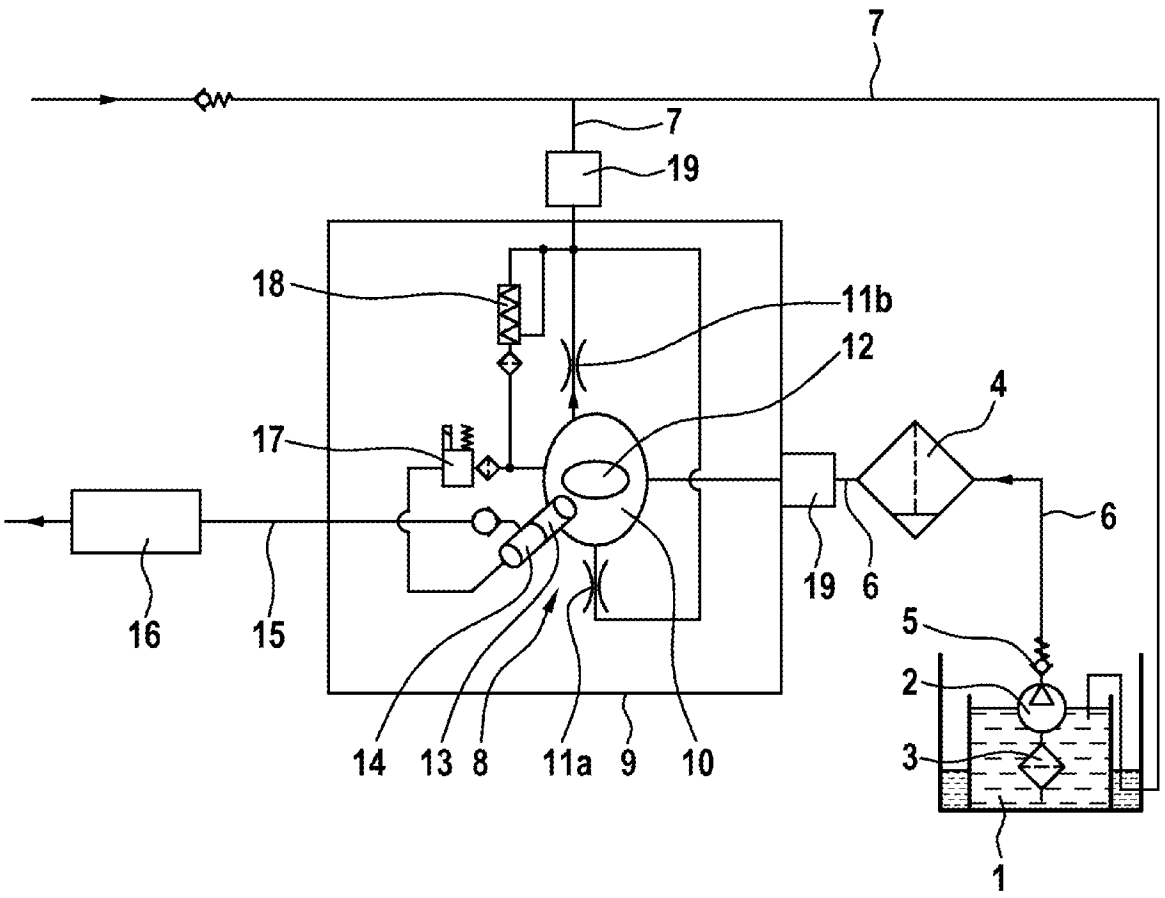
FIG. 1 a system diagram of a fuel delivery system with two optional installation possibilities for a hydraulic pressure damper, FIG. 2 a first variant of an embodiment of a hydraulic pressure damper, and FIG. 3 a second variant of an embodiment of a hydraulic pressure damper.

FIG. 1 shows a fluid conveyance system formed as a fuel delivery system for a common rail injection system. The fuel delivery system has a low-pressure conveyance system which comprises a low-pressure pump 2 installed in a tank 1, with a prefilter 3 and a check valve 5, a filter 4 and a connecting line in the form of a supply line 6 connecting the above-mentioned components together. Furthermore, the low-pressure conveyance system includes a connecting line in the form of a return line 7 which opens into the tank 1 and which is also connected to fuel injectors (not shown) in order to discharge leakage fuel. Furthermore, the return line 7 is connected to the high-pressure conveyance system, in particular a high-pressure pump 8, in order to discharge fuel not required by the high-pressure pump 8 and fuel which is pumped through the high-pressure pump for lubrication and cooling purposes. The high-pressure pump 8 has a pump housing 9, shown diagrammatically, in which a camshaft chamber 10 is formed. The camshaft chamber 10 is connected to the supply line 6 and has a camshaft 12 which is mounted on bearings 11*a*, 11*b* and is configured for example as a double camshaft. At least one high-pressure pump element cooperates with the camshaft 12 and consists substantially of a roller plunger, a pump piston 13 and a pump cylinder formed integrally with a pump cylinder head which is part of or integrated in the pump housing. On a rotary movement of the camshaft 12, the pump piston 13 is moved alternately up and down in the pump cylinder, and via a high-pressure line 15 pumps a fuel introduced into a pump working chamber 14 to a high-pressure accumulator 16, from where the fuel stored under high pressure is extracted by the fuel injectors for injection into assigned combustion chambers of an internal combustion engine.

The fuel fed into the camshaft chamber 10 is introduced, controlled by a metering unit 17, into the pump working chamber 14, while fuel which is not supplied to the pump working chamber 14 by the metering unit 17 or on idling of the internal combustion engine is discharged via a dump valve 18 into the return line 7. The bearings 11*a*, 11*b* are also connected to the return line 7, and a constant fuel quantity is conducted from the camshaft chamber 10 through the bearings 11*a*, 11*b* in particular for lubrication thereof.

A hydraulic pressure damper 19 is installed in the supply line 6 and/or the return line 7. The pressure damper 19 may be installed directly in the supply line 6 or the return line 7, or also may be integrated in the pump housing 9 of the high-pressure pump 8 in the region of the connection of the supply line 6 or the return line 7. In the context of the invention, it is expressly possible to install an independent hydraulic pressure damper in both the supply line 6 and in the return line 7, or to arrange a hydraulic pressure damper 19 either in the supply line 6 or in the return line 7.

Figure 2:
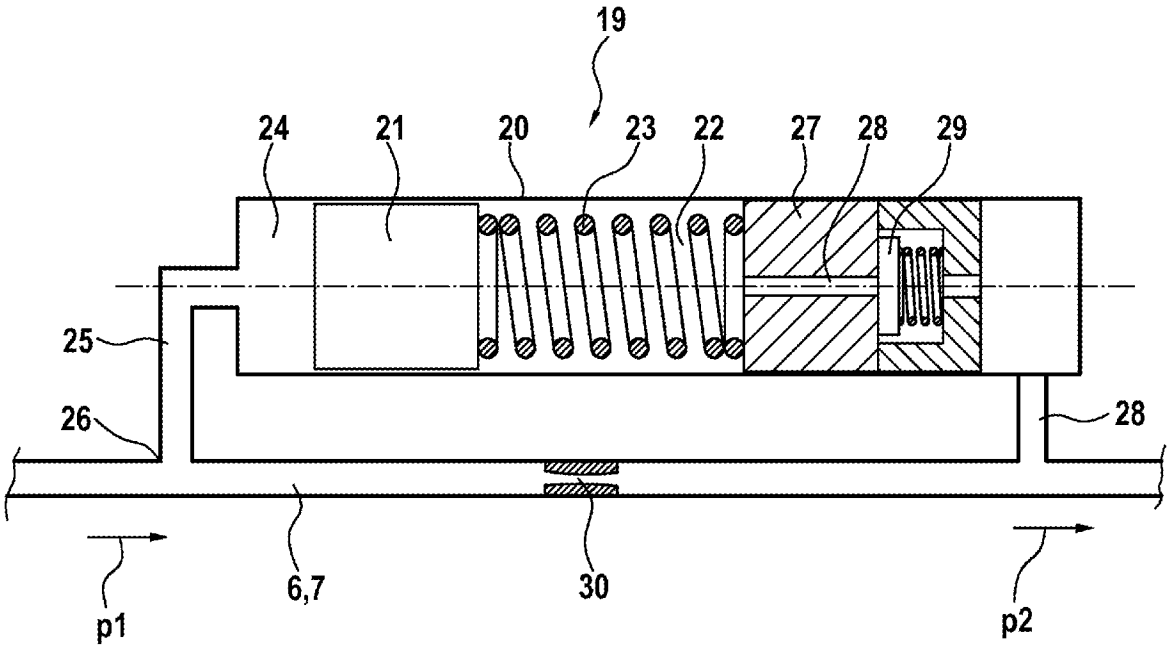
Figure 3:
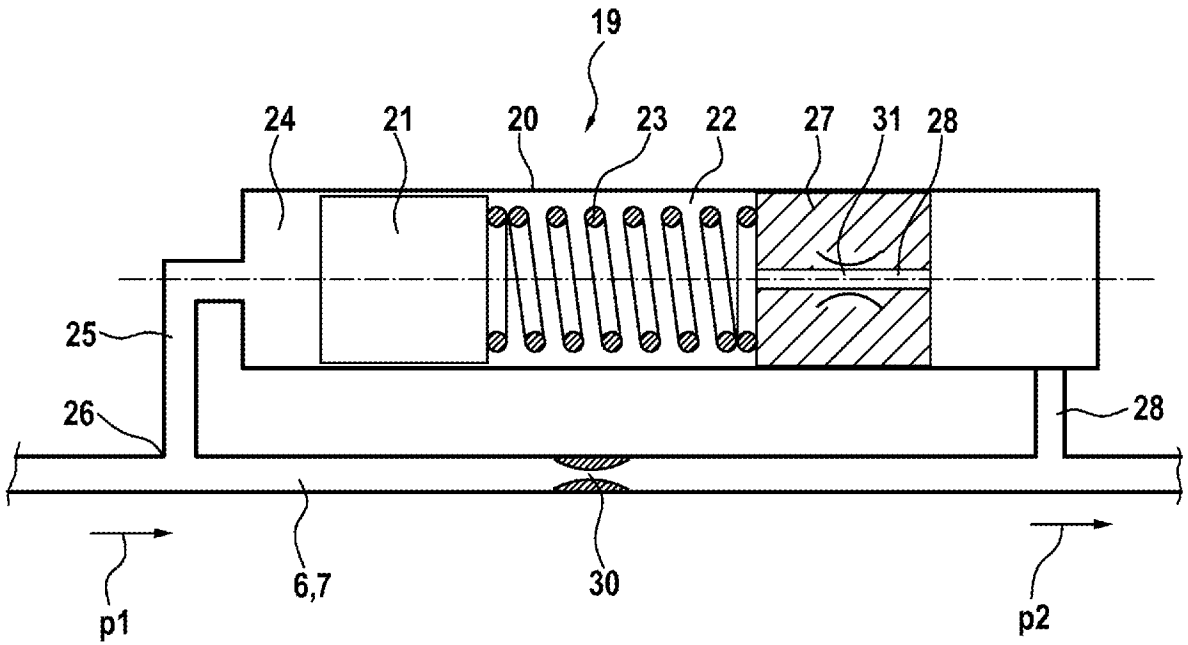

FIG. 2 shows a first exemplary embodiment of such a hydraulic pressure damper 19 which is here connected to a connecting line in the form of the supply line 6 or return line 7. The hydraulic pressure damper 19 has a damper housing in the form of a cylinder 20 in which a piston 21 is installed. The piston is subjected to the force of a compression spring 23 arranged in the compression spring chamber 22, and pressed in the direction of a damper chamber 24 which lies opposite the compression spring chamber 22 and is separated therefrom by the piston 21. The damper chamber 24 is connected via a damper supply line 25 to the connecting line in the form of the supply line 6 or return line 7 at a branch point 26.

The compression spring chamber 22 is limited opposite the piston 21 by a spring holder 27 on which the compression spring 23 rests and which contains a compression spring chamber line 28. The compression spring chamber line 28 consists of various line portions and opens downstream of the branch point 26 into the connecting line again in the form of a supply line 6 or return line 7. A check valve 29 is placed in the compression spring chamber line 28, which blocks the compression spring chamber line 28 in the direction towards the compression spring chamber 22. The check valve 29 opens at a predefined pressure in the compression spring chamber 22, and fluid present in the compression spring chamber 22 is discharged into the connecting line via the continued compression spring chamber line 28. Between the branch point 26 and the opening of the compression spring chamber line 28, a choke 30 is inserted in the connecting line which creates a differential pressure $\Delta P = P1 - P2$ at the branch point 26 or the opening of the compression spring chamber line 28. The pressure P1 is present in the damper chamber 24 via the damper supply line 25, and in stable state presses the piston 21 against the compression spring 23. In unstable state, periodic bulk waves or pressure waves of fuel which are generated in particular by the high-pressure pump 8, enter the damper chamber 24 via the damper supply line 25 and press the piston 21 in the direction of the damper chamber 24 against the force of the compression spring 23 and the pressure predominating in the damper chamber 24, which in rest state preferably corresponds at least approximately to atmospheric pressure. This state is achieved by the upward movement of the pump piston 13. On the subsequent downward movement of the pump piston 13, because the bulk wave is then no longer present, the piston 21 is moved by the compression spring 23 in the direction of the damper chamber 24 and the fuel compressed in the damper chamber 24 expands, forming or separating out vapor. This vapor, together with the fuel, with the involvement of the compression spring 23, provides the desirable damping behavior of the hydraulic pressure damper.

The exemplary embodiment in FIG. 2 differs from the exemplary embodiment in FIG. 1 only in that instead of the check valve 29, an outflow choke 31 is inserted in the compression spring chamber line 18. The outflow choke 31 or check valve 29 causes the dissipation, continuously or discontinuously respectively, of leakage which has penetrated into the compression spring chamber 22 along the piston 21.

The invention claimed is:

1. A fluid conveyance system for a fluid, comprising a low-pressure conveyance system with a low-pressure pump (2) and a high-pressure conveyance system with a high-pressure pump (8) which are connected via a connecting line, wherein fluid flows in the connecting line in a downstream direction, and wherein the fluid conveyance system has a pressure damper (19), characterized in that the pressure damper (19) is arranged in the low-pressure conveyance system and is a hydraulic pressure damper (19), wherein the hydraulic pressure damper (19) has a piston (21) arranged in a cylinder (20) and subjected to a force of a compression spring (23), wherein the compression spring (23) is arranged in a compression spring chamber (22) and a damper chamber (24) lies opposite the compression spring chamber (22) on an opposite side of the piston, wherein the damper chamber (24) is connected via a damper supply line (25) to the connecting line at a branch point (26), wherein the compression spring chamber (22) is connected by a compression spring chamber line (28) directly or indirectly to the connecting line at a point downstream of the branch point (26), and wherein the compression spring chamber line (28) has at least one of a choke (31) and a check valve (29) closing toward the compression spring chamber (22), such that, upon movement of the piston (21) in a direction of the damper chamber (24), vapor occurs by separation out of the fluid in the compression spring chamber (22) due to expansion in the compression spring chamber (22).

2. The fluid conveyance system as claimed in claim 1, characterized in that the connecting line has a second choke (30) between the damper supply line (25) and the compression spring chamber line (28).

3. The fluid conveyance system as claimed in claim 1, characterized in that the fluid conveyance system is a fuel delivery system and the fluid is fuel.

4. The fluid conveyance system as claimed in claim 1, wherein the at least one of the choke (31) and the check valve (29) closing toward the compression spring chamber (22) includes only the choke (31).

5. The fluid conveyance system as claimed in claim 1, wherein the at least one of the choke (31) and the check valve (29) closing toward the compression spring chamber (22) includes only the check valve (29) closing toward the compression spring chamber (22).

6. The fluid conveyance system as claimed in claim 1, wherein the piston does not include any passages permitting fluid flow between the compression spring chamber (22) and the damper chamber (24).

* * * * *